US005416925A

United States Patent [19]

Davis

[11] Patent Number: 5,416,925

[45] Date of Patent: May 23, 1995

[54] NECKTIE AND METHOD OF MANUFACTURE

[76] Inventor: Scott Davis, 6548 Missisippi Way, Lakewood, Colo. 80232

[21] Appl. No.: 164,461

[22] Filed: Dec. 8, 1993

[51] Int. Cl.[6] ..... A41D 25/02; A41D 25/04

[52] U.S. Cl. ..... 2/144; 2/145; 2/148; 2/149; 2/150; 2/155; 24/52

[58] Field of Search ..... 2/52, 144, 145, 148, 2/149, 150, 155, 156, 157, 151, 152.1, 153; 24/495, 52, 49 R

[56] References Cited

U.S. PATENT DOCUMENTS

| | | | |
|---|---|---|---|
| 696,363 | 3/1902 | Fleisch . | |
| 1,066,093 | 7/1913 | Ellison . | |
| 1,787,322 | 11/1929 | Minton | 2/155 |
| 1,858,429 | 5/1932 | Bedford | 2/155 |
| 2,631,292 | 3/1953 | Cunningham | 2/153 |
| 2,714,719 | 8/1955 | Peake | 2/153 |
| 2,846,688 | 8/1958 | Meeker | 24/495 |
| 2,915,757 | 12/1959 | Sofio, Sr. | 2/150 X |
| 3,187,396 | 6/1965 | Carroll | 2/148 X |
| 4,888,827 | 12/1989 | Lee | 2/52 |
| 4,977,624 | 12/1990 | Safford . | |
| 5,010,593 | 4/1991 | Stevens, Jr. | 2/153 |

FOREIGN PATENT DOCUMENTS

| | | |
|---|---|---|
| 121650 | 3/1931 | Austria . |
| 38133 | 4/1931 | France . |
| 26371 | 5/1903 | Switzerland . |
| 710248 | 2/1953 | United Kingdom . |
| 877229 | 2/1958 | United Kingdom . |

*Primary Examiner*—Jeanette E. Chapman
*Attorney, Agent, or Firm*—Sandeep Seth

[57] ABSTRACT

A necktie of the bolo type style is disclosed. The necktie includes a tie member disposable in a loop including first and second display portions and an interconnecting central portion. The display portions, sized with a larger diameter than a conventional bolo cord, are generally cylindrical and have a relatively smooth surface. A covering sheath snugly covers the display portion core and may bear one of any number of patterns and designs, including designs requiring larger surface area than provided by a conventional bolo tie cord. The necktie also includes a retainer element in a Windsor knot shape which encircles and releasably slidably engages the display portions. The retainer element includes a tapering sheath having a planar guide surface for maintaining the display portions in side-by-side relationship within the tapering sheath. A tongue extends from the tapering sheath and fastens to an opposed face of the sheath to urge the sheath to more tightly encircle the display portions and secure the retainer element at a selected position on the tie member.

16 Claims, 3 Drawing Sheets

NECKTIE AND METHOD OF MANUFACTURE

TECHNICAL FIELD

The invention generally relates to apparel and more specifically to neckties and knot structure for neckties. The invention relates, more particularly, to a necktie of the bolo tie style in which the knot or clasp is of the Windsor knot style.

BACKGROUND ART

The traditional four-in-hand necktie is a flat soft fabric construction that lends itself to being worn about the neck, generally under a folded shirt collar. Such fabric ties are knotted in the front by an adjustable slip knot such that their long flared ends overlap vertically in front. One such type of slip-knot regarded as being very symmetrical is the Windsor knot, although it consumes a substantial portion of the tie's length and can be awkwardly large if not tied snugly or if the tie is wide. With any slip knot, however, the necktie is worn with the two end portions disposed one behind the other, with their broad faces forward. The front end portion carries the knot, while the rear end portion slides through the knot. In use, the tie is worn by sliding the knotted portion over the other until the knot is snugly against the neck, bringing together two fabric strands at this same location.

Because of the difficulty in tying a good-looking knot in the traditional necktie, pre-knotted neckties that clip to the collar are commercially sold. These ties do not pass around the neck, but offer a traditional appearance when worn.

In addition, artificial knots are known that are mere slides that engage both lengths of the necktie. For example, British Patent No. 877,229 proposes such a knot formed from a laminated sheet of fabric or leather, with three flaps folded together to create the appearance of a knot. Of the three flaps, two side flaps are permanently joined, while a third, top flap carries a releasable snap-fastener. While suitable for its intended purpose, a limitation of such a knot is that it lacks the three dimensional appearance of an actual Windsor knot because the knot engages two flat lengths of a four-in-hand tie. Another limitation is that the knot does not readily retain its position tie because of the thinness and lack of rigidness of the tie surfaces.

Another British Patent, No. 710,248, proposes a similar artificial knot that engages a composite necktie, formed of a neck strap and a separate hanging portion of the tie. The hanging portion snaps to a top flap of the artificial knot, which also is passed over the neck strap. Then, side flaps snap to the top flap, locking the three part necktie together. This knot suffers a same limitation as British Patent No. 877,229 knot in that it encircles a flat tie length and lacks three-dimensionality.

It would be desirable to have a tie utilizing the convenience of some type of pre-formed and adjustable Windsor knot but which would give a three dimensional realistic look to the knot and would retain its position.

An alternative style of tie is the bolo, which is a length of narrow cord with its opposite end, portions held together by a clasp, but displayed side-by-side. Most commonly, the bolo cord is formed of three strands of leather, or the like, braided together. The clasp is metal, often decorated with stones or other jeweler's art, and is carried on the cord by metal fingers or a ring. Because of the nature of the clasp and cord, the tie is worn loosely, with relatively more space between the union of the cord ends and the wearer's neck. Often the bolo tie is considered less formal than the traditional necktie, perhaps because of the loose fit and sparse cord construction. Typically, the bolo is worn with more casual clothing and is regarded as Western or country wear. Furthermore, because of its structure, no formal or traditional type of knot is readily tied on the cord.

It would be desirable to improve the versatility of the bolo style tie, by creating a more traditional and substantial appearance that allows such a tie to appear more formal. In this regard, the present invention provides a new structure for the bolo style tie, in which allows the cord to have a much more substantial structure while maintaining its comfort.

It would be further desirable to enable the bolo style tie to be worn in a more formal and traditional manner. In this regard, the present invention enables the bolo style tie to be worn with a formal, Windsor style knot.

It would further be desirable if such a bolo style tie provided a Windsor style knot which was three-dimensional and realistic in appearance but easy to use without the need for tying. In addition, such an improved bolo style tie would desirably permit the knot to guide the two end portions of the cord such that they are naturally disposed side by side within the knot rather than in a front/rear arrangement heretofore known. The improved knot structure further would desirably permit the knot to be drawn closely to the neck such that the top of the knot may form a neat line with a shirt collar.

Still further, the improvements in the bolo style tie should allow the knot to be retained at the neck or any other desired position and provide a novel method for adjusting the knot.

To achieve the foregoing and other objects and in accordance with the purpose of the present invention, as embodied and broadly described herein, the bolo style tie and method of manufacture of the new knot of this invention may comprise the following.

DISCLOSURE OF INVENTION

Against the described background, it is therefore a general object of the invention to provide an improved bolo style tie in which the cord portion is constructed of substantially wider stock than previously practical. By this achievement, the bolo tie gains the ability to carry designs, patterns and textures previously found only in traditional cloth neckties.

Another object is to provide a formal, Windsor style knot adaptable to the bolo style tie. A slidable, independent knot has been developed that employs known three-flap construction but adapts such construction to supporting the bolo cords in side-by-side relationship. Further, the knot structure is adapted to maintain its position on the cords, and the bolo cord structure itself is adapted to permit the knot to be raised to the collar without discomfort.

Additional objects, advantages and novel features of the invention shall be set forth in part in the description that follows, and in part will become apparent to those skilled in the art upon examination of the following or may be learned by the practice of the invention. The object and the advantages of the invention may be realized and attained by means of the instrumentalities and in combinations particularly pointed out in the appended claims.

According to the invention, a necktie of the bolo tie style is provided with an elongated tie member disposable in a loop. This tie member employs first and second display portions disposable generally parallel to each other and with their respective free ends extending in the same direction. In addition, a central portion interconnects the display portions. At least the display portions are cylindrical in cross-section and are regular in surface texture. A retainer element is formed of a tapering sheath having two opposed faces and tapering sides defining opposite wide and a narrow openings. A tongue is joined to the sheath at the wide opening, and a fastening device is provided for selectively fastening a distal end of the tongue to an opposed face of the sheath diametrically opposite the junction of the tongue and sheath. The tapering sheath commonly encircles the display portions, is disposed with its wide opening facing the central portion, and maintains the display portions in side-by-side juxtaposition therein. The tongue, when fastened to an opposed face of said tapering sheath, is interposed between said display portions, subtends the wide opening into two laterally spaced sub-openings, each receiving a single display portion, and tightens said retainer element against said display portions.

In a preferred embodiment of the present invention, a rear face of the tapering sheath is defined by two overlapping wing areas, each wing area extending rearwardly from the front face and forming one tapered side of the tapering sheath, the overlapping portion of said wing areas defining a reinforced planar guide means for guiding said display portions in substantial side-by-side juxtaposition.

The accompanying drawings, which are incorporated in and form a part of the specification illustrate preferred embodiments of the present invention, and together with the description, serve to explain the principles of the invention. In the drawings:

BRIEF DESCRIPTION OF THE DRAWING8

BEST MODE FOR CARRYING OUT THE INVENTION

Figure 1:
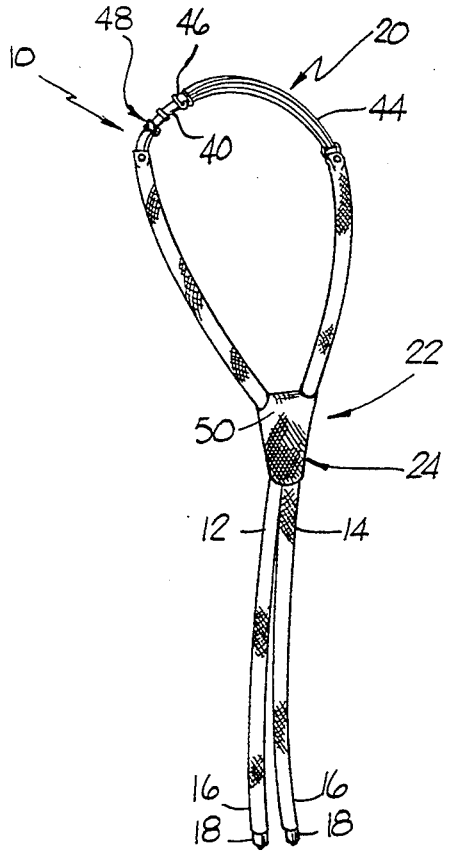
FIG. 1 is a perspective view of a necktie of the present invention illustrating an embodiment having a flat central portion having means for adjusting the same.
Figure 2:
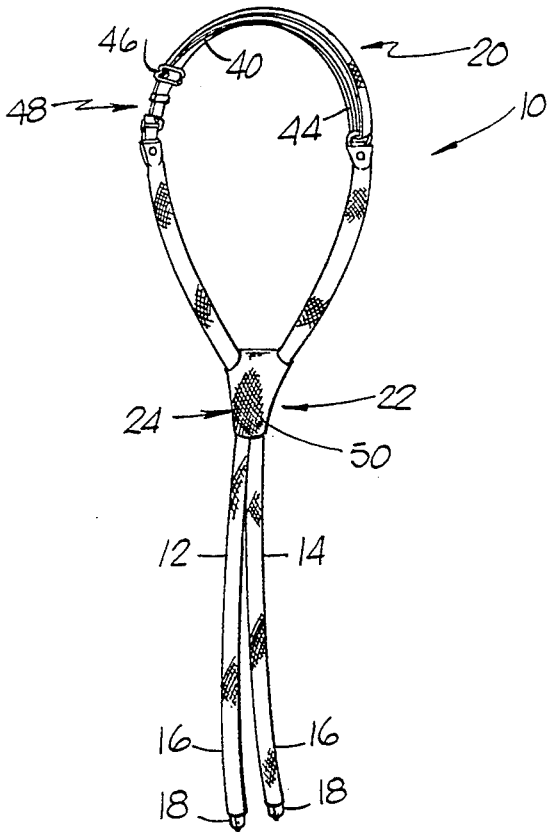
FIG. 2 is a front view of the necktie of FIG.1
Figure 3:
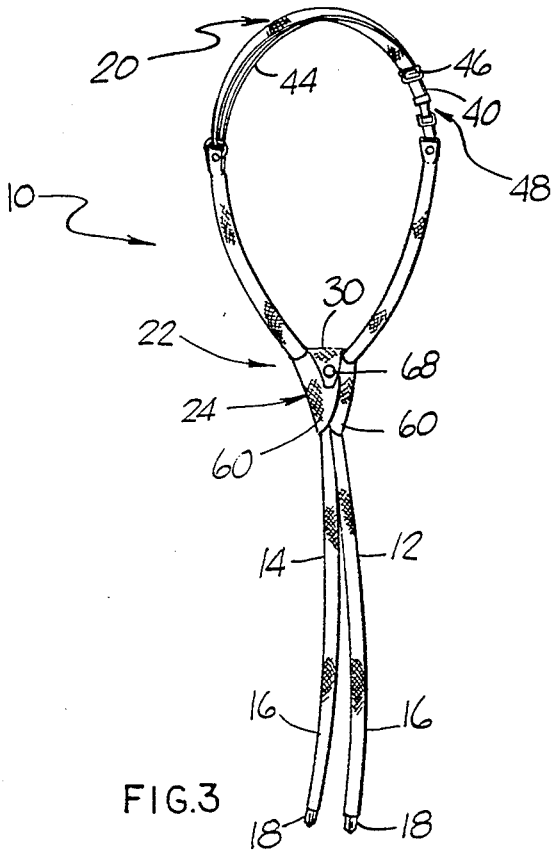
FIG. 3 is a rear view of the necktie of FIG. 1 illustrating the rear face of the retainer element.
Figure 4:
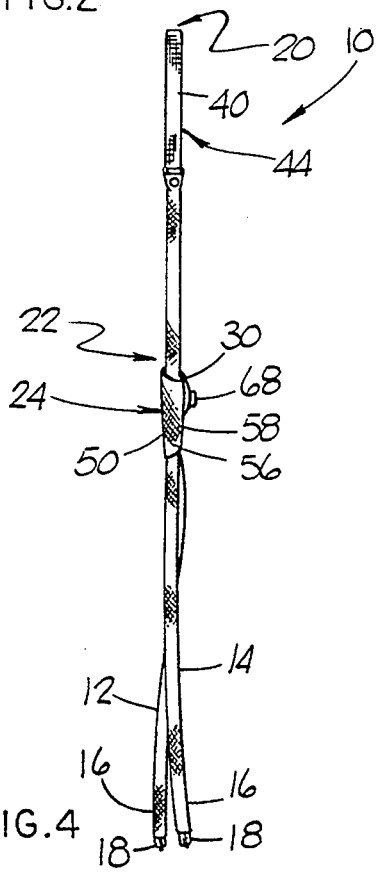
FIG. 4 is a side elevation view of the necktie of FIG. 1
Figure 5:
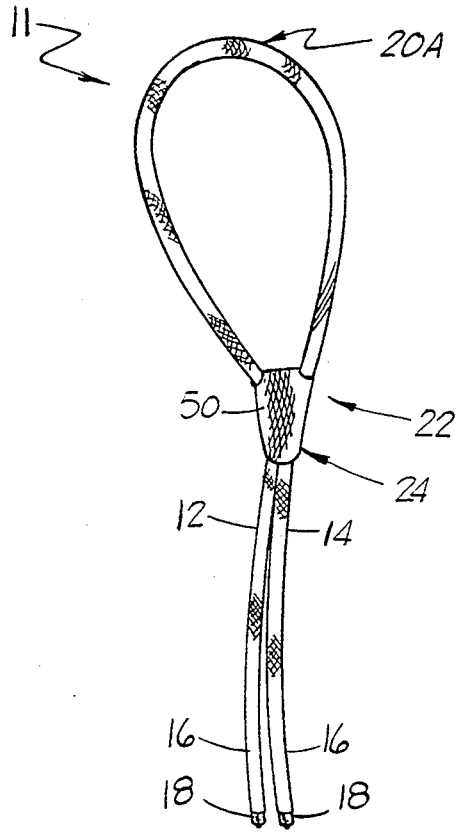
FIG. 5 is a perspective view of a necktie of the present invention illustrating an embodiment having a continuous central portion.
Figure 6:
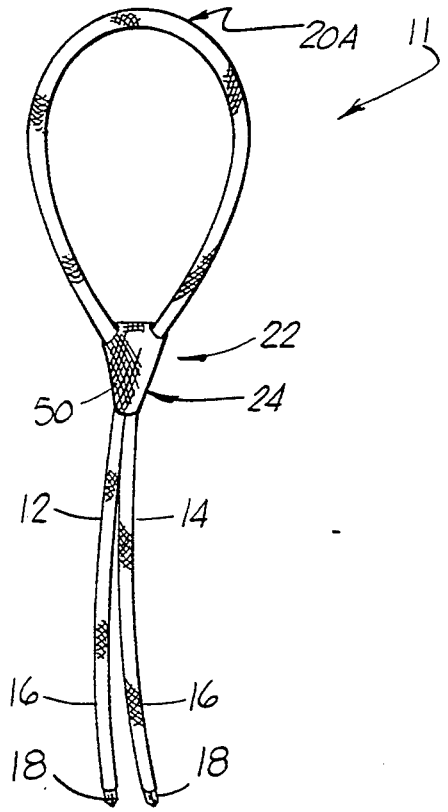
FIG. 6 is a front view of the necktie of FIG. 5.

FIGS. 1–15 disclose two alternate embodiments of an necktie of the bolo type style 10 and 11 which, in addition to other improvements, combine the utilities of the bolo style tie and a knot having a conventional Windsor style appearance. A traditional bolo style tie (not shown) consists of a length of cord, typically formed from three strands of twined leather, having a very narrow cross-sectional area. The cord is looped about the wearer's neck, in use, typically underneath a shirt collar and the two free end portions of the cord are displayed side-by-side in front of the wearer's chest area. An ornamental concha piece, typically made of metal and/or stonework, has a pair of rear facing clasps each of which clasp one end portion of the cord. The traditional bolo tie is usually worn with the top button of the wearer's shirt open and with the concha selectively secured below the V-shaped open portion of the shirt so that the tie hangs loosely about the neck.

In accordance with an important aspect of the present invention, the cord of the traditional bolo tie is replaced by a tie member (not numbered) which consists of a central portion 20 interconnecting first and second elongated display portions 12, 14. The free ends 16 of the display portions 12, 14 are capped by a cap, or capping means 18, preferably lightweight metal, fixedly disposed thereon to prevent the free ends from deteriorating. In accordance with another important aspect of the present invention, the concha of the traditional bolo tie is replaced by a retainer element 22 in the shape and having the look of a conventional Windsor-style knot. The retainer element 22 is comprised of a tapering sheath 24 having a wide top opening 26 and narrow bottom opening 28 to slidably encircle the display portions 12, 14. The wide opening 26 is disposed facing the central portion 20. A tongue 30 extends over wide opening 26 to define two opposed laterally spaced sub-openings 34 and give the appearance of a finished Windsor knot.

Figure 15:
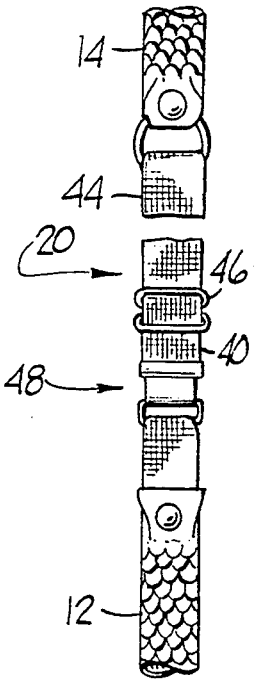
FIG. 15 is an enlarged fragmentary top view illustrating a tie element with a directionally biased covering sheath and the flat band.
Figure 10:
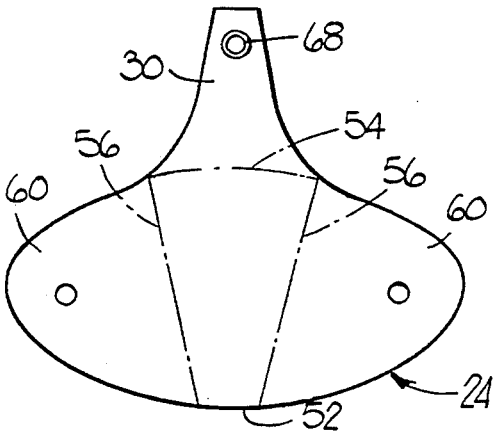
FIG. 10 is an enlarged front view illustrating a blank of planar material for forming a tapering sheath and tongue for the retainer element.
Figure 11:
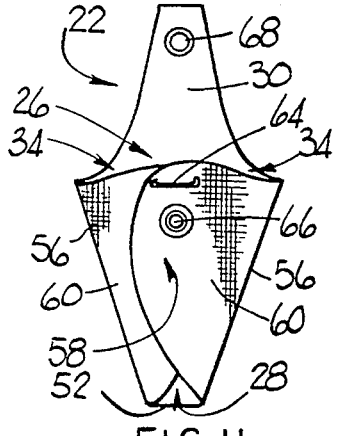
FIG. 11 is an enlarged rear view illustrating the blank with opposed wing portions folded to form the rear face of the tapering sheath.
Figure 12:
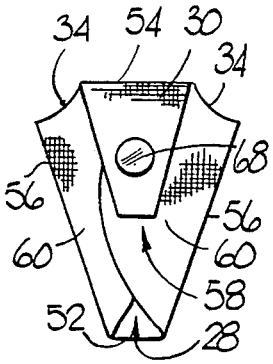
FIG. 12 is an enlarged rear view illustrating the blank with the tongue fastened to the rear face of the tapering sheath.
Figure 14:
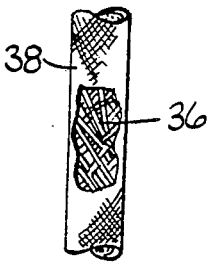
FIG. 14 is an enlarged fragmentary front view illustrating a display portion with a portion a covering sheath cut-away to show a core.

As shown in the figures, the display portions 12, 14 are elongated and generally cylindrical in cross section and disposable generally parallel to each other and with their respective free ends extending in the same direction. Unlike the conventional bolo tie, in which the surface of the cord is irregular, the surface of the display portions 12, 14 is regular. Regular, herein, is defined as having surface irregularities or indentations smaller than those created when only a few stands of a material, e.g. 2–5 strands, are twined to form the cord. As shown in FIG. 14, the display portions 12, 14 are comprised of a cylindrical core 36 of flexible material having a regular surface texture, preferably 16 piece braided nylon rope, giving a smoother surface consistency not obtainable from 3 or 5 piece twined rope (or leather). A covering sheath 38 is snugly disposed overlying the core along the length of each display portion 12, 14. Because the covering sheath 38 only has minimal surface irregularities from snugly overlying the core 36, the display portions 12, 14 provide a relatively regular sliding surface for the retainer element 22 to readily slide thereon. The covering sheath 38 is formed from conventional fabric such as silk, satin, nylon, cotton, polyester or other conventional fabric. The fabric may be printed or dyed with any desired color or pattern and conventionally rolled and seamed to form the covering sheath 38. In this manner, it will be appreciated that the appearance limitations of a traditional bolo cord are removed allowing a necktie of the present invention to bear an infinite variety of colors, fabrics and patterns to match with clothing or convey any image desired by the manufacturer. If will be appreciated that the present invention thus provides for a bolo style tie to have all of the varieties of a conventional four-in-hand tie. As shown in FIG. 15, artificial or natural leather and suede materials may also be used to form the covering sheath 38. Covering sheaths made from materials having a directional bias, such as scaled skins, are disposed on the display portions 12, 14 such that the directional bias lies in substantially a single direction when the display portions are generally parallel to each other with their respective free ends extending in the same direction. in this manner, the retainer element 22 has a common effect, e.g. raising or lowering the scales, when slid over the longitudinal direction of the display portions 12, 14. It will also be appreciated that cloth patterns having a directional bias will be similarly disposed on the display portions 12, 14 so that the pattern matches on either display portion. It will further be appreciated that a single covering sheath 38 may be cut into two segments to readily accomplish each segments proper disposal on a display portion. In this specification, a directional bias is not considered as an irregular display portion surface.

The core 36 further has a cross-sectional diameter which is larger than a typical bolo cord. Preferably, the core 36 is sized at approximately $\frac{3}{8}$ inch diameter, or larger, as opposed to the typical $\frac{1}{8}$ inch diameter of a bolo cord. As will be appreciated, patterns requiring a relatively larger surface area such as logos, insignias, emblems or other designs and/or trademarks may be displayed on the display portions 12, 14 that could not be displayed on a conventional bolo cord. It is contemplated that a popular novelty of the present invention will be the capability for the display portions to bear such large designs.

As shown in FIGS. 1–4 and in FIG. 15, the display portions 12, 14 of necktie 10 are connected by a central portion 20. The central portion 20 preferably consists of a flat flexible elastic band 40 such as those commonly stitched to underwear. As will be appreciate, such a flat band 40 allows for greater comfort when the necktie 10 is worn under a tight collar, such as a button-down collar, and particularly when the retainer element 22 is adjusted to the top button of the shirt. The covering sheath 38 of display portion 14 extends slightly beyond its respective core 36 adjacent to the central portion 20 and folded over and riveted, or otherwise secured. A conventional plastic ring (not numbered) is secured within the fold. A free end of the flat band 40 extends through the apertures of a conventional clip means 46 and loop through the retainer and back to clip means 46 to which is securely connected. In this conventional manner, a loop portion 44 of the flat band 40 is created which can be adjusted to selectively alter the length of the central portion 20. Though the loop portion 44 and the clip means 46 act as a preferable means for adjusting the central portion 20, other means may be also employed as central portion adjusting means. It will be appreciated that in this manner, the necktie 11 may be uniformly manufactured of a single display portion length to fit a variety of neck sizes. Engaging means 48, best shown in FIG. 15 as a flat hook, is attached to the other end of flat band 40 and releasably engaged to a second plastic ring attached an adjacent end of the display portion 12. In this manner, necktie 10 need not be placed over the wearers head to be worn.

In the embodiment 11 of the present invention illustrated in FIGS. 5–8, the central portion 20 is shown integral with display portions 12, 14 so that the tie member is one continuous element comprised of a single core 36. Necktie 11 may be worn more like a traditional bolo tie with the top shirt button open and the retainer element 22 adjustably located below the open V-shaped formed thereby. Necktie 11 may also be worn with a loose collared shirt with the top shirt button closed and the knot located at the top-button area such as in with conventional four-in-hand tie bearing a Windsor knot. It will be appreciated that necktie 11 is capable of serving as one of intermediate formality between necktie 10 and a conventional bolo tie.

As shown in FIGS. 10–13, the retainer element 22 is formed from a blank of flexible planar material configured with a central area (not numbered) having two opposed laterally adjoining wing areas 60 extending therefrom. When comprised of an outer layer of a fabric facing material, the blank is stiffened with at least one layer of stabilizer, preferably pellon, disposed on the interior (non-facing) surface of the blank. In this manner the blank can maintain a more rigid three dimensional shape. The central area forms a generally trapezoidal front face 50 of the tapering sheath 24. A small flat portion on a bottom curvilinear surface of the blank forms a narrow base 52 of the front face 50. The central area also provides a wide top 54 of the front face. The wing areas 60 are angularly folded rearward into an overlapping arrangement to form a rear face 58 of the sheath 24 which is generally parallel to the front face 50. A portion of each wing area forms one tapered side 56 of and partly defines the narrow opening 28 at the bottom of the sheath 24. A joining means 64, preferably a metal staple located laterally centrally near the top of the rear face 58, interconnects the wing areas 60, in substantially non-pivotal relationship. In accordance with an important aspect of the present invention, the overlapped portions of wing areas 60 define a reinforced planar area, or guide means, of greater stiffness than the other areas of the tapering sheath 24. The reinforced planar area forces the display portions 12, 14 to more naturally remain in side-by-side relationship within the tapering sheath rather than becoming oriented in a substantially front/rear relationship with respect to each other. A first part 66, preferably a button rivet, of a two part fastening means extends rearwardly at a laterally central position on the rear wall 58 from the interior of sheath 24 through each wing area 60.

Figure 7:
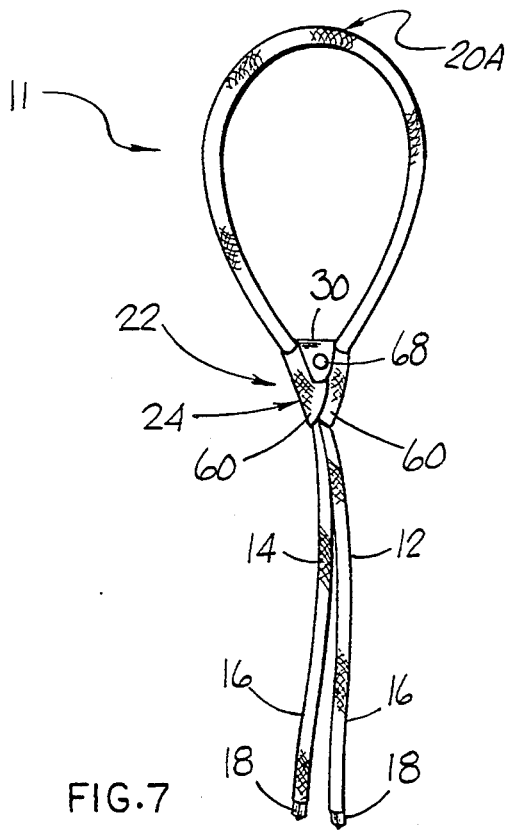
FIG. 7 is a rear view of the necktie of FIG. 5 illustrating the rear face of the retainer element.
Figure 8:
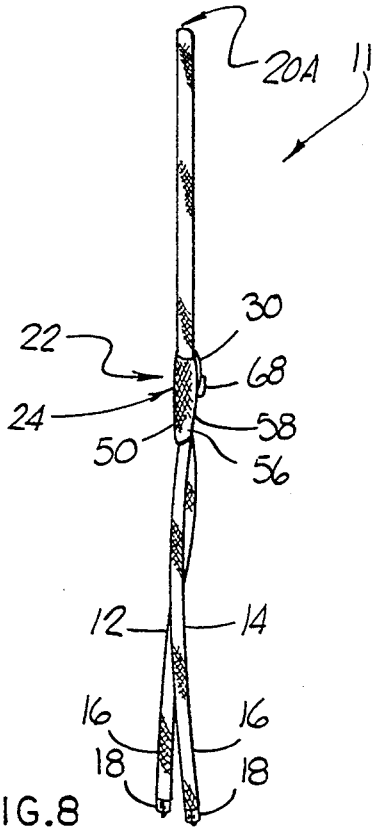
FIG. 8 is a side elevation view of the necktie of FIG. 5.
Figure 9:
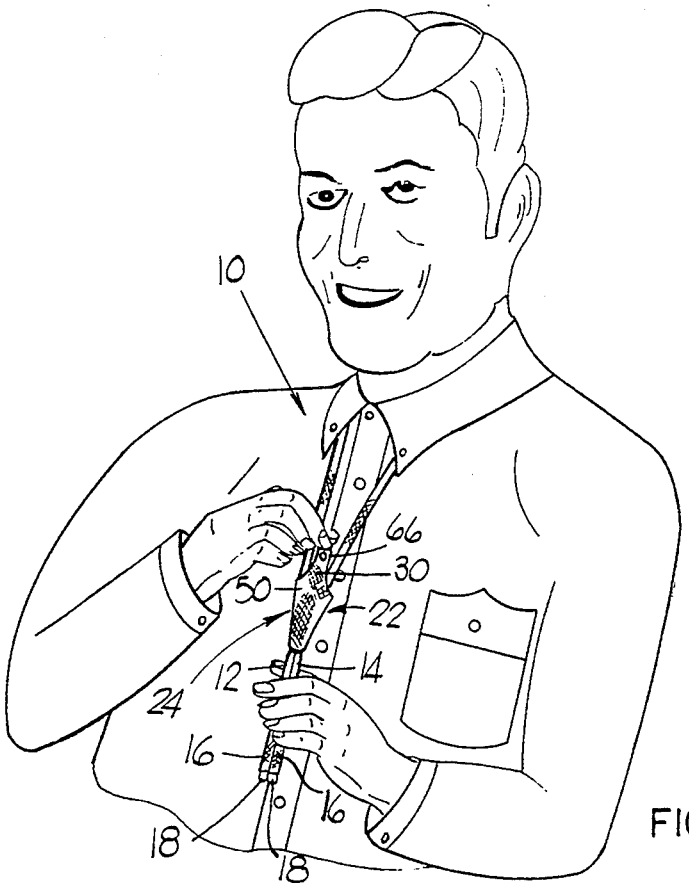
FIG. 9 is a perspective view illustrating a necktie of the present invention in use disposed about a wearer's neck.

A trapezoidally configured tongue area extends from the top of the central area of the blank to form the tongue 30. The second part 68, preferably a glove snap, of the fastening means is fastened at a laterally central point towards the distal end of the tongue 30 such that when the tongue is folded approximately at the broad top 54 of the front face 50 and lapped over the rear face 58, the glove snap 68 is in a fastening position with the button rivet 66. In such position, the tongue 30 subtends the wide opening 26 of the sheath to define two opposed laterally spaced sub openings 34, each sub-opening for receiving one display portion 12, 14. When fastened to the rear wall 58, the tongue urges the tapering sheath 24 to more tightly encircle the display portions 12, 14 to frictionally secure the retainer element 24 against the display portions at a selected position along the longitudinal dimension of the display portions. Furthermore, as best shown in FIG. 7, the trapezoidal configuration of the tongue 30 may be sized to further urge each display portion 12, 14 against its respective side 56, with the tongue fastened to the rear face 58, to further frictionally secure the retainer element 22 against the display portions 12, 14. As will be appreciated, the substantial diameter of the display portions 12, 14 facilitate the retainment of the retainer element 22 at the selected location thereon.

Figure 13:
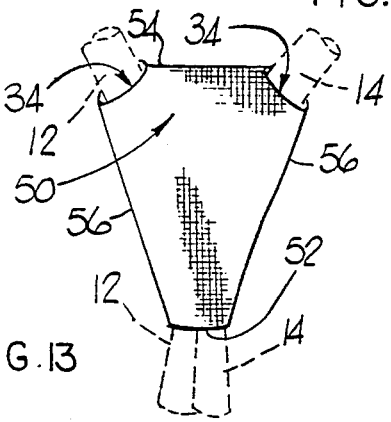
FIG. 13 is an enlarged front view illustrating the retainer element in cooperation with a pair of display portions of the necktie with each display portions entering the sheath through a sub-opening and exiting though a narrow opening.

As best shown in FIG. 13, the narrow opening 28 of tapering sheath 24 is sized slightly smaller in length than two display portion diameters so that it is under tension when it receives the display portions 12, 14 and the tapered sides 56 are slightly constricted about the display portions even when the tongue 30 is not fastened to the rear face 58 of the sheath 24. While not shown, a metal jacket having approximately the same shape as the retainer element 22 may be releasably engaged on the top surface 54 of retainer element by means of a rearwardly extending curved lip having approximately the same length as the top surface. The metal jacket also may include concha type stonework and is used as further ornamentation.

In use, the central portion is disposed about the wearers neck. If not already so, the display portions 12, 14 are placed side-by-side within the tapering sheath 24 with the front face 50 of the tapering sheath facing away from the wearer. The retainer element 22 is pulled upwardly by its tongue 30 to a desired point on the longitudinal dimension of the display portions, preferably at the top button of the shirt, and fastened to the rear face 58 of the tapering sheath to secure the retainer element 22 to the display portions 12, 14 of the tie member. To loosen the retainer element 22 prior to removal of the necktie 10 or 11, the tongue is unfastened and each of the display portions 12, 14 are alternatively tugged downwardly causing the retainer element 22 to shimmy down the longitudinal dimension of the display portions. Then necktie 10 is removed by disengaging engaging means 48 and necktie 11 is removed by sliding it over the wearer's head.

From the foregoing, it is appreciated that a necktie of the bolo style is provided which has more substantial structure upon which patterns and designs may be displayed and which may employ any of the same materials used in four-in-hand ties. The necktie is adapted for use with a preformed Windsor knot which gives a realistic and formal appearance to the necktie and which is easy to use with the necktie and retains its selected position on the necktie.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

I claim:

1. A necktie of the bolo style, comprising:

first and second elongated generally cylindrical display portions having a diameter greater than $\frac{1}{8}$ inch providing a sufficiently large provide a large surface area for bearing decorative matter, said display portions disposable generally parallel to each other in side-by-side juxtaposition with their respective free ends extending in the same direction and said display portions comprising a core of flexible material and a covering sheath for snugly overlying said core;

a central portion interconnecting said elongated display portions; and a retainer element comprising:

a flexible tapering sheath for slideably encircling said display portions and for maintaining said display portions against one another in side-by-side juxtaposition, said tapering sheath having a pair of opposed faces and tapered sides interconnecting said opposed faces, wherein said opposed faces and tapered sides define opposite wide and narrow openings, said narrow opening sized to be in tension when said display portions emerge therefrom in side-be-side juxtaposition;

a flexible tongue extending from said tapering sheath at the wide opening; and fastening means for selectively fastening a free end of said flexible tongue to an opposed face of said tapering sheath;

wherein said tongue, when lapped over said wide opening and fastened to an opposed face of said tapering sheath, is interposed between said display portions, urges each of said display portions against its respective tapered side of said tapering sheath, and tightens said tapering sheath against said display portions to frictionally secure said retainer element against said display portions at a selected longitudinal position along said display portions to maintain said display portions in said side by side juxtaposition.

2. The invention of claim 1, wherein: said covering sheath bears a directionally biased surface topography and is disposed on each of said display portions such that the directional bias lies in substantially a single direction when said display portions are generally parallel to each other and with their respective free ends extending in the same direction.

3. The invention of claim 1, wherein said core comprises a braided member.

4. The invention of claim 3, wherein said braided member comprises rope.

5. The invention of claim 4, wherein said rope comprises sixteen piece braided rope.

6. The invention of claim 1, wherein said core is at least $\frac{3}{8}$ inch in diameter.

7. The invention of claim 1, wherein said central portion is also generally cylindrical in cross-section and continuous with said first and second display portions.

8. The invention of claim 1, wherein said central portion comprises a substantially flat band.

9. The invention of claim 8, wherein said flat band comprises elastic material.

10. The invention of claim 8, further comprising adjusting means for selectively altering the length of said central portion.

11. The invention of claim 10, wherein said adjusting means comprises a looped portion of said flat band and a clip means moveable with respect to the length of said flat band for closing said looped portion and for selectively altering the length of said central portion.

12. The invention of claim 8, further comprising engaging means for releasably connecting said flat band to one of said display portions.

13. The invention of claim 1, further comprising: capping means engaged on each of the free ends of said display portions for covering said free ends to prevent the free ends from deteriorating.

14. The invention of claim 1, wherein said opposed faces of said tapering sheath comprise a front face and a rear face, and wherein:

said front face is configured approximately as a trapezoid having a narrow base, wide top, and tapered edges, wherein said tongue extends from said front face along said wide top; and said rear face is configured generally as said front face and is formed by a pair of overlapping wing areas, each said wing area extending rearwardly from one said tapered edge of said front face and forming one said tapered side of said tapering sheath, the overlapping portions of said wing areas also defining a reinforced planar guide means for guiding said display portions in substantial side-by-side juxtaposition.

15. The invention of claim 14 further comprising:

means for joining together said wing areas in a substantially non-pivotal relationship; and wherein said fastening means comprises a two part fastener, wherein a first fastener part is carried by at least one of said wing areas and located generally laterally centrally with respect to said rear face, and a second fastener part is carried by said tongue in a position permitting the two fastener parts of said fastening means to be fastened together when said tongue is folded approximately at said broad top and lapped over the rear face.

16. The invention of claim 15, wherein:

said means for joining together the wing areas is located more than one-half the distance from the base to the top of said rear face; and said narrow opening of said retainer element is at the base of the trapezoidal configuration, and when not receiving said display portions therethrough is smaller than the opening size required to receive said display portions, such that the narrow opening is under tension when said display portions are received therethrough and said tapering sides of said retainer element are constricted about said display portions.

* * * * *

UNITED STATES PATENT AND TRADEMARK OFFICE

CERTIFICATE OF CORRECTION

PATENT NO. : 5,416,925

DATED : May 23, 1995

INVENTOR(S) : Scott Davis

It is certified that error appears in the above-identified patent and that said Letters Patent is hereby corrected as shown below:

In Column 8, line 10, the language in Claim 1 which states "provide a large" should be deleted.

Signed and Sealed this

Seventeenth Day of December, 1996

*Attest:*

Bruce Lehman

BRUCE LEHMAN

*Attesting Officer*

*Commissioner of Patents and Trademarks*